US007200888B2

(12) United States Patent
Nieson

(10) Patent No.: US 7,200,888 B2
(45) Date of Patent: Apr. 10, 2007

(54) SPLASH GUARD FOR FLOOR SCRUBBING MACHINE

(76) Inventor: Terry R. Nieson, 821 Mount Pleasant Road, Oxford, Nova Scotia (CA) B0M 1P0

( * ) Notice: Subject to any disclaimer, the term of this patent is extended or adjusted under 35 U.S.C. 154(b) by 139 days.

(21) Appl. No.: 11/149,329

(22) Filed: Jun. 10, 2005

(65) Prior Publication Data

US 2005/0273965 A1 Dec. 15, 2005

Related U.S. Application Data

(60) Provisional application No. 60/578,831, filed on Jun. 14, 2004.

(51) Int. Cl.
*A47L 11/40* (2006.01)

(52) U.S. Cl. ..... 15/50.1; 15/49.1; 15/246; 451/455

(58) Field of Classification Search ..... 15/49.1, 15/50.1, 246; 451/353, 451, 455
See application file for complete search history.

(56) References Cited

U.S. PATENT DOCUMENTS

| | | | |
|---|---|---|---|
| 789,576 | A | 5/1905 | Stewart |
| 2,153,481 | A | 4/1939 | Ponselle |
| 2,981,966 | A | 5/1961 | Beffel |
| 3,010,135 | A | 11/1961 | Pollnow, Jr. |
| 3,122,769 | A | 3/1964 | Doersam |
| 3,153,251 | A | 10/1964 | Ohlson |
| 3,733,635 | A | 5/1973 | Carden |
| 4,330,897 | A | 5/1982 | Tucker et al. |
| 4,435,870 | A | 3/1984 | Tucker et al. |
| 4,510,643 | A | 4/1985 | Kitada |
| 4,809,385 | A | 3/1989 | Bogue |
| 4,903,364 | A | 2/1990 | Long |
| 5,280,663 | A | 1/1994 | Proulx |
| 5,394,585 | A | 3/1995 | Connelly |
| 5,432,970 | A | 7/1995 | Reid |
| 5,513,413 | A | 5/1996 | Myers et al. |

FOREIGN PATENT DOCUMENTS

| | | | |
|---|---|---|---|
| CA | 2403602 | * | 4/2004 |

* cited by examiner

*Primary Examiner*—Mark Spisich
(74) *Attorney, Agent, or Firm*—Mario Theriault

(57) ABSTRACT

The splash guard comprises an apron defining a horseshoe shape having an open rear end along a vertical plane. A rectangular frame encloses the open rear end. The rectangular frame has a centre of gravity rearward of the vertical plane, to keep the rear end of the apron taut. The rectangular frame also has adjustment clamps to allow the adjustment of the width thereof to different floor-scrubbing machines. In another aspect, the apron has a double thickness along each end of the horseshoe shape, to prevent buckling of the apron near the open rear end thereof.

20 Claims, 2 Drawing Sheets

SPLASH GUARD FOR FLOOR SCRUBBING MACHINE

This application claims benefit of provisional application No. 60/578,831, filed 14 Jun. 2004.

FIELD OF THE INVENTION

This invention pertains to an adjustable splash guard for mounting around a floor-scrubbing machine to prevent water, detergent, wax and other debris from being spattered around the machine.

BACKGROUND OF THE INVENTION

Floor-working machines of interest herein have motor-driven disc-like brushes mounted horizontally. These machines were first developed for buffing waxed floors. The brushes on these machines are easily interchangeable and when stiff-bristle brushes are used, the machines are capable of doing difficult floor-cleaning jobs such as scrubbing old wax from linoleum floors. A floor scrubbing operation is normally carried out with water and liquid detergent, and therefore, it is preferable to install a splash guard around the base of the machine to prevent splashing detergent on wall bases and on the legs of furniture for examples. Because of the double functions of these machines, the splash guards are easily removable.

Typically, a splash guard of the prior art consists of strip of stiff material bend to form a low cylinder around the base of a floor-scrubbing machine. The guard is simply laid on the floor around the machine and let to slide on the floor surface to follow the movements of the machine. Examples of splash guards of the prior art are shown in the following documents:

U.S. Pat. No. 2,981,966 issued to R. Beffel on May 2, 1961;

U.S. Pat. No. 3,010,135 issued to F. J. Pollnow, Jr. on Nov. 28, 1961;

U.S. Pat. No. 3,122,769 issued to H. F. Doersam on Mar. 3, 1964;

U.S. Pat. No. 3,153,251 issued to D. E. Ohlson on Oct. 20, 1964;

U.S. Pat. No. 3,733,635 issued to C. A. Carden on May 22, 1973;

U.S. Pat. No. 4,330,897 issued to J. R. Tucker et al. on May 25, 1982;

U.S. Pat. No. 4,435,870 issued to J. R. Tucker et al. on Mar. 13, 1984;

U.S. Pat. No. 4,809,385 issued to L. D. Bogue on Mar. 7, 1989;

U.S. Pat. No. 5,280,663 issued to L. L. Proulx on Jan. 25, 1994;

U.S. Pat. No. 5,513,413 issued to T. Myers et al. on May 7, 1996.

Floor cleaning of commercial buildings is often done by private contractors, and the floor machines used are often carried from one building to another in a contractor's vehicle. The equipment carried by these contractors include large containers of detergent, mop-wrinkling buckets, wide brooms, floor-scrubbing/polishing machine, gloves, shoes, etc. Before starting a cleaning job, this equipment is carried by hand from the contractor's vehicle to the working area, often requiring several trips to the vehicle. A second manipulation of this equipment is effected at the completion of the cleaning job. The splash guards of the prior art are bulky as these are made of stiff material and have diameters to enclose a floor machine entirely. Therefore, the transporting of such a splash guard to and from a job site and the storing thereof between uses represents a significant burden.

Although the prior art splash guards deserve undeniable merits, it is believed that a need still exists for a splash guard that can be folded into a compact arrangement for storage and that is easily deployed for use.

SUMMARY OF THE INVENTION

In the present invention, however, there is provided a splash guard that is made of pliable material and that can be folded in a compact arrangement between uses.

In one aspect of the present invention, there is provided a splash guard for mounting around a floor-scrubbing machine. The splash guard has an apron defining a horseshoe shape having an open rear end along a vertical plane. A rectangular frame encloses the open rear end. The rectangular frame has a centre of gravity rearward of the vertical plane to keep the rear end of the apron taut.

In another aspect of the present invention, the rectangular frame has adjustment clamps to selectively adjust the rectangular frame to the widths of different machines.

In yet another aspect of the present invention, the apron has a double thickness along each end of the horseshoe shape, to prevent buckling of the apron near the open rear end thereof.

This brief summary has been provided so that the nature of the invention may be understood quickly. A more complete understanding of the invention can be obtained by reference to the following detailed description of the preferred embodiment thereof in connection with the attached drawings.

BRIEF DESCRIPTION OF THE DRAWINGS

One embodiment of the present invention is illustrated in the accompanying drawings, in which like numerals denote like parts throughout the several views, and in which.

DESCRIPTION OF THE PREFERRED EMBODIMENT

Figure 1:
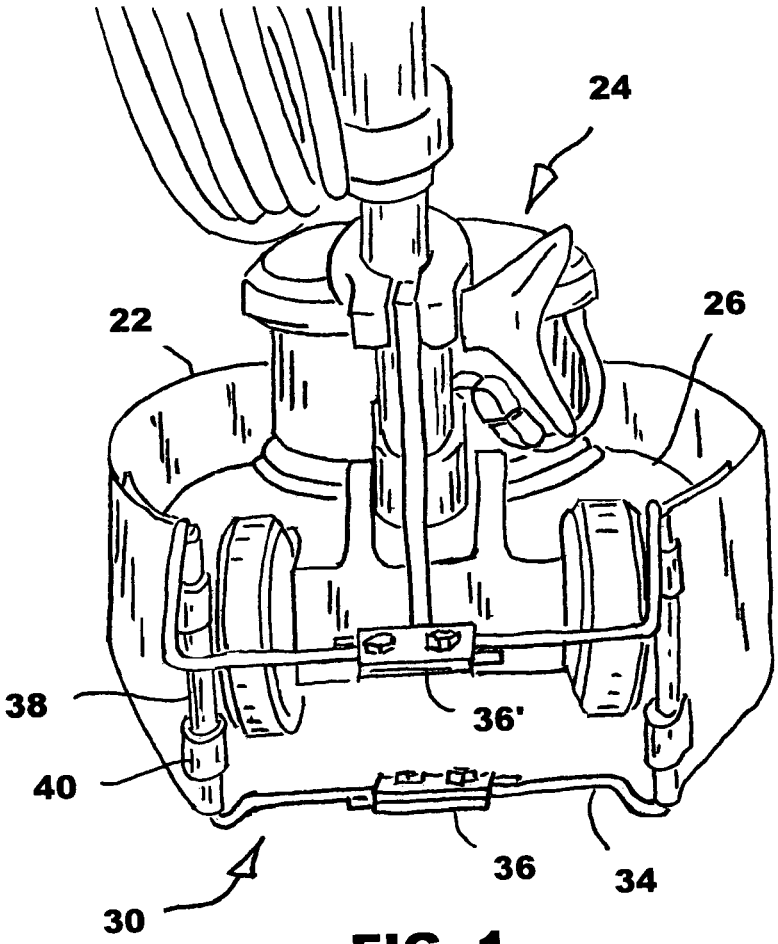
FIG. 1 is a rear view of a floor-scrubbing machine with the splash guard according to the preferred embodiment mounted there around.
Figure 2:
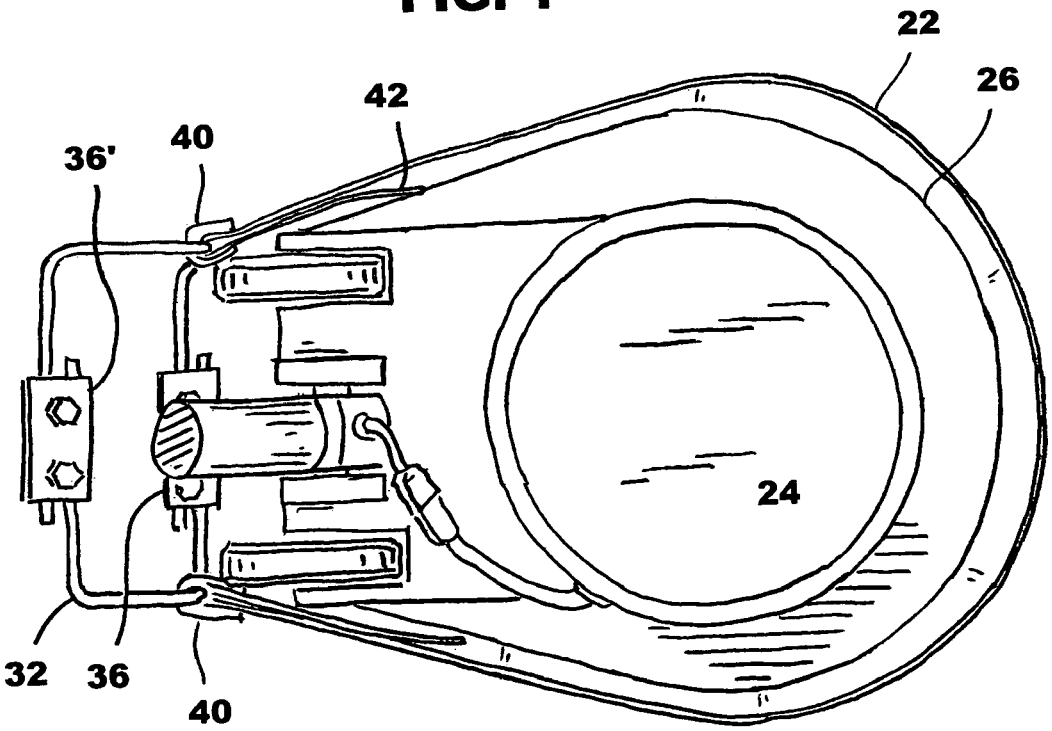
FIG. 2 is a top view of the floor-scrubbing machine with the preferred splash guard installed there around.
Figure 3:
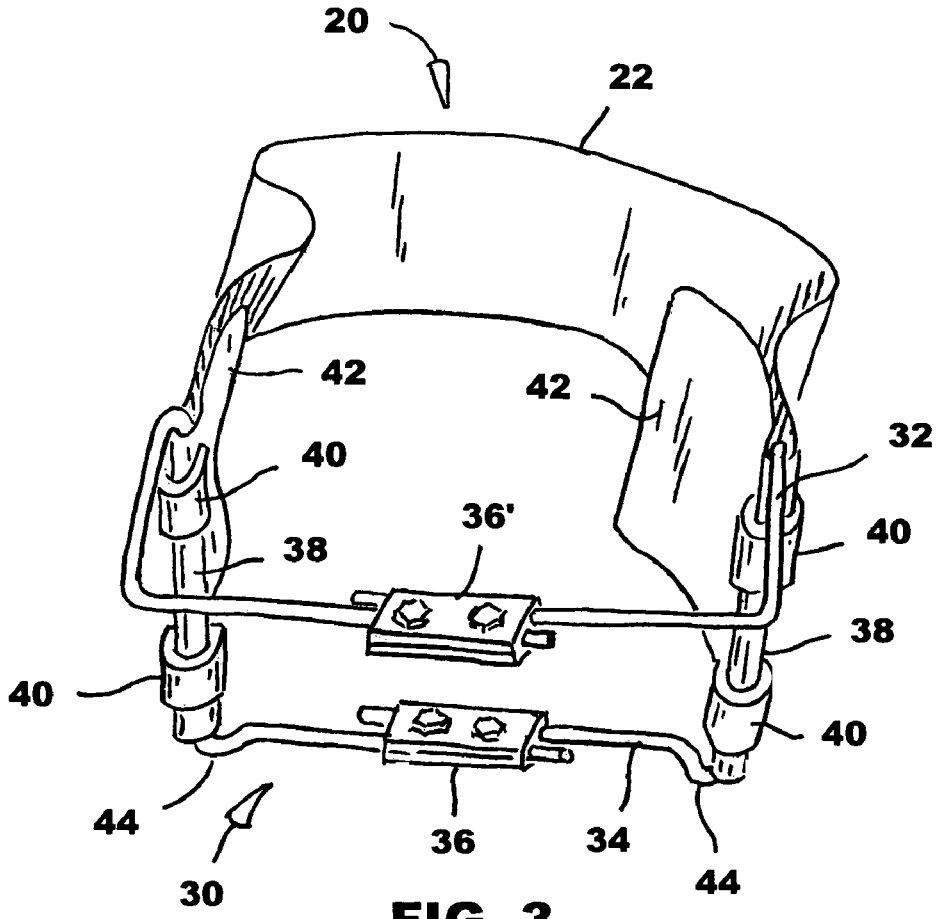
FIG. 3 is a rear view of the preferred splash guard.

While this invention is susceptible of embodiment in many different forms, there is shown in the drawings and will be described in details herein one specific embodiment, with the understanding that the present disclosure is to be considered as an example of the principles of the invention and is not intended to limit the invention to the embodiment illustrated and described.

Referring to FIGS. 1–4, the preferred splash guard 20 consists primarily of a flexile apron 22 defining a horseshoe shape around the circumference of a floor-scrubbing machine 24, and enclosing the rim 26 of the scrubbing machine. The splash guard 20 is mounted loosely around to the rim of the machine, with its lower edge floating on the floor so as to contain the detergent, wax or other fluid under the scrubbing machine. The flexible apron 22 is made of a pliable vinyl sheeting material having a thickness of about ⅛ inch or slightly less, and a height of about 6 inches.

In use, the rim 26 of the floor-scrubbing machine prevents the circular portion of the apron 22 from buckling or tilting sideways.

The splash guard 20 also has an open rear end along a vertical plane 28, and a rectangular frame 30 enclosing this open rear end. The rectangular frame 30 comprises two C-shaped stiff rods 32 facing each other and wherein their horizontal segments 34 overlap and are joined together by a pair of rod clamps 36,36'. The rectangular frame 30 prevents the rear end of the splash guard 20 from tilting sideways. The width of the rectangular frame 30 is adjustable by means of the rod clamps 36, 36'.

The rectangular frame 30 has two spaced-apart, parallel, vertical segments 38, one along each rod 32, defining the aforesaid vertical plane 28. The ends of the apron 22 are folded over the vertical segments 38 and are held to the each vertical segment 38 by a pair of C-shaped clips 40. The apron 22 is longer than the circumference of the scrubbing machine and the excess lengths 42 on both sides extend inside the horseshoe shape and overlap the end segments of the horseshoe shape. Because of the excess lengths 42, the C-shaped clips 40 and the rod clamps 36, 36', the splash guard 20 is adjustable to various types and shapes of floor-scrubbing machines.

The stiff rods 32 are bent in such a way as to position the upper clamp 36' rearward of the lower one 36, relative to the vertical plane 28, to accommodate for the movement of the handle of the floor-scrubbing machine and to move the centre of gravity of the rectangular frame 30 rearward of the vertical plane 28.

Figure 4:
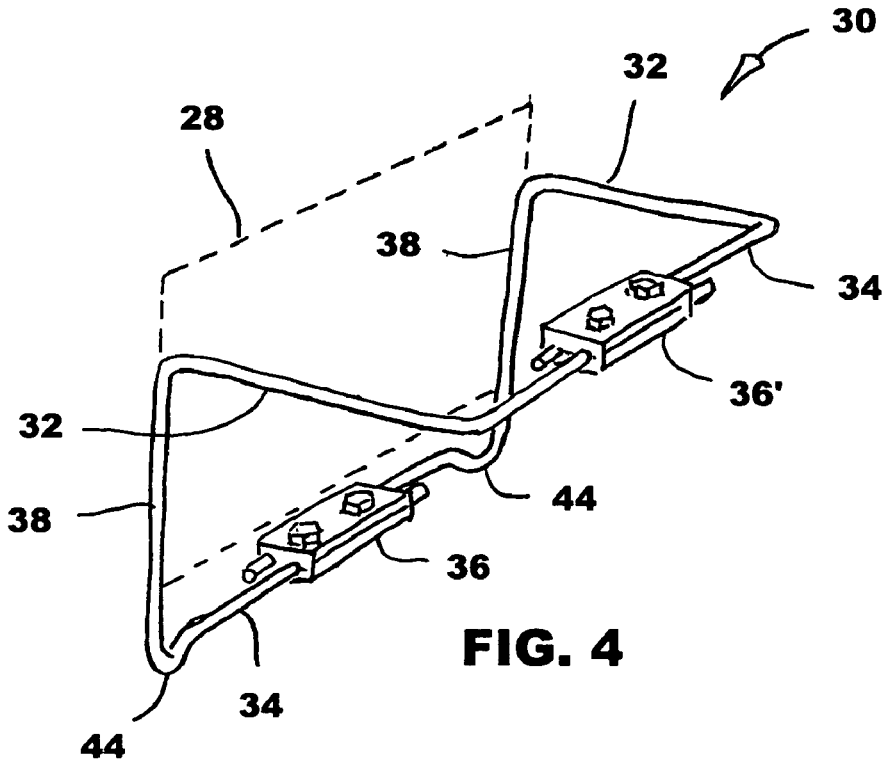
FIG. 4 is a perspective view of the rectangular frame enclosing the rear end of the preferred splash guard.

Referring particularly to FIG. 4, the rectangular frame has a pair of heel portions 44 at the lower ends of the vertical segments 38, to raised the lower horizontal segments 34 and the lower rod clamp 36 off the floor.

The rectangular frame 30 defined by the stiff rods 32 prevents the apron from buckling near the open rear end of the splash guard. The double thicknesses caused by the excess lengths 42 in the apron 22 near the open rear end also contribute to prevent buckling of the apron 22 near the open rear end.

When the splash guard 20 is not used, it can be folded onto itself and within the rectangular frame 30 to form a compact package that is easily transported or stowed away.

What is claimed is:

1. A splash guard for mounting around a floor-scrubbing machine, comprising;

an apron defining a horseshoe shape having an open rear end along a vertical plane;

a rectangular frame enclosing said open rear end, said rectangular frame having a centre of gravity rearward of said vertical plane, and means to adjust a width of said rectangular frame.

2. The splash guard as claimed in claim 1, wherein said apron is made of pliable material.

3. The splash guard as claimed in claim 2, wherein said pliable material is a flexible vinyl sheeting material having a thickness of about ⅛ inch.

4. The splash guard as claimed in claim 1, wherein said rectangular frame has two spaced-apart, parallel vertical segments and said apron is folded around said vertical segments.

5. The splash guard as claimed in claim 4, further comprising C-clips enclosing said vertical segments and retaining said apron over said vertical segments.

6. The splash guard as claimed in claim 5, wherein said apron has double thicknesses along the ends of said horseshoe shape.

7. The splash guard as claimed in claim 1, wherein said rectangular frame is made of two C-shaped stiff rods facing each other and having horizontal segments overlapping each other.

8. The splash guard as claimed in claim 7, wherein said means for adjusting a width comprises a pair of rod clamps mounted over said horizontal segments.

9. The splash guard as claimed in claim 8, wherein said pair of rod clamps comprises an upper rod clamp and a lower rod clamp, and said upper rod clamp is rearward said lower rod clamp relative to said vertical plane.

10. The splash guard as claimed in claim 9, wherein said rectangular frame has two spaced-apart, parallel vertical segments and each of said vertical segments has a heel portion on a lower end thereof, for supporting said lower rod clamp off a floor surface.

11. A splash guard for mounting around a floor-scrubbing machine, comprising;

an apron defining a horseshoe shape having an open rear end along a vertical plane; said apron being-made of pliable material;

a rectangular frame enclosing said open rear end, said rectangular frame having a centre of gravity rearward of said vertical plane; said rectangular frame being made of two C-shaped stiff rods having horizontal segments overlapping each other and two spaced-apart parallel vertical segments defining said vertical plane; said C-shaped rods facing each other, and said apron being folded around said vertical segments;

a plurality of C-clips enclosing said vertical segments and retaining said apron over said vertical segments, and a pair of rod clamps adjustably retaining said horizontal segments of said rectangular frame to each other for selectively adjusting a width of said rectangular frame.

12. The splash guard as claimed in claim 11, wherein said pliable material is a flexible vinyl sheeting material having a thickness of about ⅛ inch and a height of about 6 inches.

13. The splash guard as claimed in claim 11, wherein said wherein said pair of rod clamps comprises an upper rod clamp and a lower rod clamp, and said upper rod clamp is rearward said lower rod clamp relative to said vertical plane.

14. The splash guard as claimed in claim 13, wherein said rectangular frame has two spaced-apart, parallel vertical segments and each of said vertical segments has a heel portion on a lower end thereof, for supporting said lower rod clamp off a floor surface.

15. The splash guard as claimed in claim 11, wherein said apron has double thicknesses along the ends of said horseshoe shape.

16. In combination, a floor-scrubbing machine and a splash guard mounted around a rim of said floor-scrubbing machine, wherein said splash guard comprises;

an apron defining a horseshoe shape extending around said rim and having an open rear end along a vertical plane;

a rectangular frame enclosing said open rear end, said rectangular frame having a centre of gravity rearward of said vertical plane, and means to adjust a width of said rectangular frame.

17. The combination as claimed in claim 16 wherein said rectangular frame is made of two C-shaped stiff rods facing each other and having horizontal segments overlapping each other, and a pair of rod clamps mounted over said horizontal segments.

18. The combination as claimed in claim 17 wherein said pair of rod clamps comprises an upper rod clamp and a lower rod clamp, and said upper rod clamp is rearward said lower rod clamp relative to said vertical plane.

19. The combination as claimed in claim 16 wherein said rectangular frame has two spaced-apart, parallel vertical segments and said apron is folded around said vertical segments; and said splash guard further comprises a plurality of C-clips enclosing said vertical segments and retaining said apron over said vertical segments.

20. The combination as claimed in claim 19, wherein said apron has double thicknesses near said vertical segments.

* * * * *